US005281183A

United States Patent [19]

Bernhardt et al.

[11] Patent Number: 5,281,183

[45] Date of Patent: Jan. 25, 1994

[54] SOLENOID MECHANISM FOR MOVEMENT OF FIGURE PORTIONS

[75] Inventors: Gary C. Bernhardt, East Hills; Michael J. Vaught, South Salem, both of N.Y.

[73] Assignee: Core Enterprises International, Inc., Mineola, N.Y.

[21] Appl. No.: 973,021

[22] Filed: Nov. 9, 1992

[51] Int. Cl.[5] ..... A63H 3/40; A63H 33/26

[52] U.S. Cl. ..... 446/345; 446/131; 446/139

[58] Field of Search ..... 446/129, 131, 137, 138, 446/139, 337, 341, 342, 343, 345, 346, 348, 349, 389, 392, 393

[56] References Cited

U.S. PATENT DOCUMENTS

| | | | |
|---|---|---|---|
| 1,432,205 | 10/1922 | Petrow | 446/342 |
| 2,614,362 | 10/1952 | Zavala | 446/129 X |
| 2,854,788 | 10/1958 | Baggott | 446/342 X |
| 3,383,793 | 5/1968 | Bonanno | 446/130 |
| 3,570,178 | 3/1971 | Green | 446/343 |
| 3,616,572 | 11/1971 | Kosicki et al. | 446/346 |
| 3,660,932 | 5/1972 | Raffeli et al. | 446/337 X |

FOREIGN PATENT DOCUMENTS

| | | | |
|---|---|---|---|
| 1206425 | 9/1970 | United Kingdom | 446/129 |

*Primary Examiner*—David N. Muir
*Attorney, Agent, or Firm*—Jones, Day, Reavis & Pogue

[57] ABSTRACT

An apparatus for animating a figurine movable element having a pivot point for pivotally coupling the movable element to the figurine to allow the movable element to pivot between the first position and a second position, a first portion of the movable element extending in front of the pivot point and a second portion of the movable element extending behind the pivot point; a hollow solenoid on the figurine with an elongated steel shaft having one end inserted in the hollow solenoid winding and the other end pivotally attached to the second portion of the movable element behind the pivot point such that the shaft pivots the movable element between the first position and the second position depending upon the solenoid operation.

9 Claims, 2 Drawing Sheets

SOLENOID MECHANISM FOR MOVEMENT OF FIGURE PORTIONS

BACKGROUND OF THE INVENTION (1) Field of the Invention

The present invention relates in general to apparatus for animating a movable element of a figurine and specifically relates an eye mechanism for mounting in an animated figurine to enable an eyeball replica with a pupil thereon to appear to blink.

(2) Description of Related Art

Animated figurines are well known in the art and include animal forms as well as human forms. These figurines walk, roll over, dance, talk, move their arms and provide various other animated features. It is extremely difficult and expensive to provide the necessary mechanical and electromechanical devices and configurations which enable the animation of the figurine.

Movement of the eye is a particularly difficult procedure. In simple doll mechanisms, a weight is pendulously attached to a pivoting eyeball replica such that when the doll is in the upright position, the eyes appear to be open and, when the doll is placed on its back, the weight pivots downwardly thus closing the eye.

In newer versions of animated figures, the figure may speak, if a person, or bark, if a dog, or make other sounds. When the electrical signals for causing the voice and/or movements of the eye, mouth, arms and legs are generated from a data storage device such as a magnetic tape, the eyes, mouth, arms and legs may be caused to be moved in coordination by the signals stored on the tape such as disclosed in commonly assigned copending U.S. patent application Ser. No. 07/943,766 filed Sep. 11, 1992 and entitled TALKING FIGURE WITH ANIMATED FEATURES. In that case, pulses are stored on a magnetic tape that coordinate with the speech sounds digitally recorded on the tape. When the tape is activated, the sounds on the tape are coupled to a circuit and speaker for producing the sounds. Pulses recorded on the tape are coupled to a circuit that decodes the pulses and provides a signal to a solenoid for movement of the eyes, arms, legs, mouth or tail, if an animal is involved. In order to keep the costs within reasonable limits for such a device, it is necessary that an electromechanical arrangement be devised to move the element in question is a simple, efficient and economical manner.

SUMMARY OF THE INVENTION

The present invention relates to apparatus for animating a figurine movable element such as an eyeball replica with a pupil thereon to appear to blink. Of course, the device could be used for moving other appendages on an animated figure but will be discussed herein in relation to an eyeball replica. A housing is located in the animated figure inside the head in juxtaposed relationship to an opening for an eye. A replica of an eyeball having an eye pupil thereon is pivotally attached to the housing at a pivot point to allow the eye replica to rotate to various positions between a first completely open position and a second completely closed position. A solenoid winding with a hollow core is attached to the housing and a shaft has one end inserted in the hollow core of the solenoid winding and the other end pivotally attached to the eyeball replica behind the pivot point. The weight of the shaft holds the eyeball pupil in the first open position when the solenoid is de-energized and then pivots the eyeball and its pupil to a point between the first and the second positions when the solenoid is energized to cause the eye to appear to blink. If a short pulse of sufficient time duration is applied to the solenoid, it will cause a quick movement of the eyeball from the first position to a maximum second position depending upon the amount of current applied to the solenoid winding. Thus, the eyeball may be caused to pivot from a fully open position to a fully closed position and to any position therebetween.

The housing includes a first hollow cylinder having an open end for pivotally receiving the eyeball replica such that the pupil of the eyeball replica faces out of the open end. A second hollow cylinder is placed above and has its longitudinal axis normal to the longitudinal axis of the first hollow cylinder for receiving the hollow core solenoid winding. A recess is formed on each side of the open end of the first hollow cylinder in opposed relationship and a corresponding projection is formed on each side of the eyeball replica for mating with the opposed recesses such that the eyeball replica is pivotable about the projections between the first and second positions. On one end of the solenoid shaft is a spool having an I-shape in longitudinal cross section. A pair of spaced fingers are attached at one end to the eyeball replica and are placed about and along each side of the center portion of the I-shaped spool such that, upon movement of the shaft longitudinally in either direction, the spaced fingers catch one of the top and bottom horizontal portions of the I-shaped spool to cause the eyeball replica to move about its pivot points. A conduit extends longitudinally through the I-shaped spool and one end of the elongated solenoid shaft is press fit into the conduit for attachment thereto. Of course, it could be attached in any other well-known manner.

A substantially hemispherical eye shield is fastened to the open end of the first hollow cylindrical portion of the housing. A substantially oval-shaped opening is formed in the eye shield through which the pupil of the eyeball replica can be seen as it pivots to give the appearance of blinking. An annular recess is formed in the first hollow cylinder portion of the housing adjacent the open end and an annular flange is formed on the base of the substantially hemispherical eye shield for insertion in the annular recess to secure the eye shield to the housing.

Again, the movable element could be any other figurine movable element instead of the eye so long as it includes a housing pivot point for pivotally coupling the movable element to the figurine to allow the movable element to pivot from a first position to a second position with a first portion of the movable element extending in front of the pivot point and a second portion of the movable element extending behind the pivot point. A hollow solenoid winding can be mounted on the housing in the appropriate location with an elongated shaft having one end inserted in the hollow core solenoid winding and the other end pivotally attached to the second portion of the movable element behind the pivot point. The weight of the shaft then holds the movable element in the first position when the solenoid is de-energized and the solenoid causes the shaft to move the element to a second position when the solenoid is energized.

Thus, it is an important feature of the present invention to provide a simple mechanical movement for animating a figurine movable element.

It is another important feature of the present invention to provide an eye mechanism mounting for an animated figure to enable an eyeball replica with a pupil thereon to appear to blink.

It is yet another feature of the present invention to provide a figurine element animating apparatus that includes an elongated shaft coupled between a solenoid and a pivotable movable element at a location behind the pivot point such that the weight of the shaft holds the element in a first position when the solenoid is not energized and moves the element to a second position when the solenoid is energized.

Thus, the invention relates to apparatus for animating a figurine movable element comprising a housing in the figurine having a pivot point for pivotally coupling the movable element to the housing to allow the movable element to pivot from a first position to a second position, a first portion of the movable element extending in front of the pivot point and a second portion of the movable element extending behind the pivot point. A hollow core solenoid winding is mounted on the housing and an elongated shaft has one end inserted in the hollow core solenoid winding and the other end is pivotally attached to the second portion of the movable element behind the pivot point such that the weight of the shaft holds the movable element in the first position when the solenoid is de-energized and the solenoid causes the shaft to move the element to a second position when the solenoid is energized.

The invention also relates to an eye mechanism for mounting in an animated figurine to enable an eyeball replica with a pupil thereon to appear to blink comprising a housing coupled to the animated figure, a replica of an eyeball having an eye pupil thereon, pivot means for attaching the eyeball replica to the housing at a pivot point to allow the eye replica to rotate between a first position and a second position, a hollow core solenoid winding on the housing and a shaft having one end inserted in the hollow solenoid winding and the other end pivotally attached to the eyeball replica behind the pivot point such that the weight of the shaft holds the eyeball pupil in the first position when the solenoid is de-energized and the eyeball pupil is pivoted to the second position when the solenoid is energized to cause the eye to appear to blink.

BRIEF DESCRIPTION OF THE DRAWINGS

These and other objections of the present invention will be more fully understood when taken in conjunction with the accompanying drawings in which.

DETAILED DESCRIPTION OF THE DRAWINGS

Figure 1:
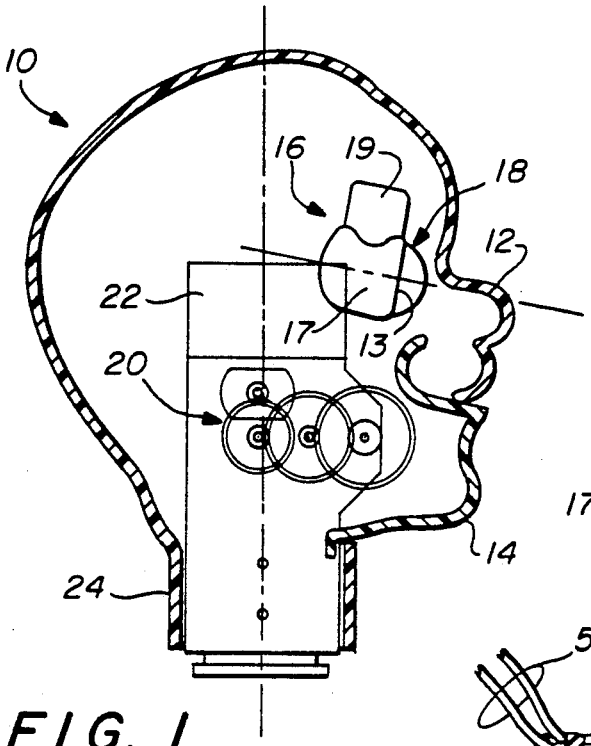
FIG. 1 is a simplified cross-sectional view of the head of an animated figure illustrating an eyeball housing and a mechanism for moving a mouth portion.

FIG. 1 is a generalized cross-sectional view of the head 10 of an animated figure. While in this case the figure is generally represented as a human, it is to be understood that the invention could also be used in figures that represent animals, inanimate objects and the like. The head 10 has a nose 12 and a movable mouth 14. An eye movement mechanism 16 has a replica of an eyeball 18 therein having an eye pupil 15 thereon and is associated with an opening 13 in the figurine 10 such that the eyeball 18 can be seen through the opening. The eye mechanism 16 includes a housing having a first hollow cylinder 17 having an open end 31 through which the eyeball replica 18 projects. A second hollow cylinder 19 is above and has its longitudinal axis normal to the longitudinal axis of the first hollow cylinder 17 for receiving a hollow core solenoid winding as will be seen hereafter. A driving mechanism 20 formed of a gear train is coupled to the jaw 14 to move the mouth in open and closed positions, respectively. The gear train 20 is driven by a motor 22. A neck portion 24 is available for attaching the figurine head to the body of the figurine in any well-known manner.

Figure 2A:
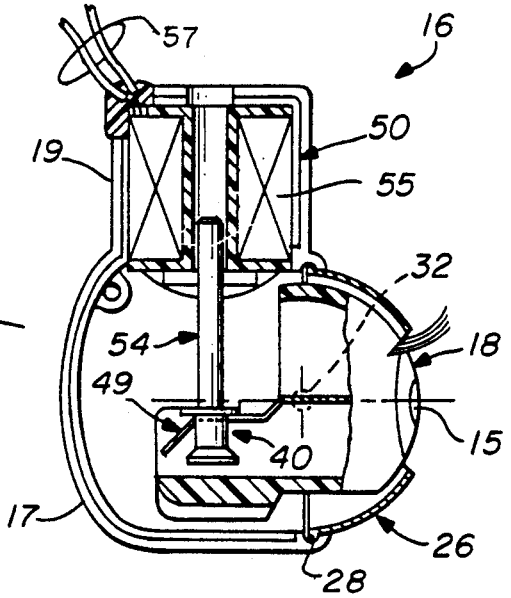
FIG. 2A is a cross section of the novel eye-moving mechanism of the present invention with the eyeball replica in the open position.
Figure 2B:
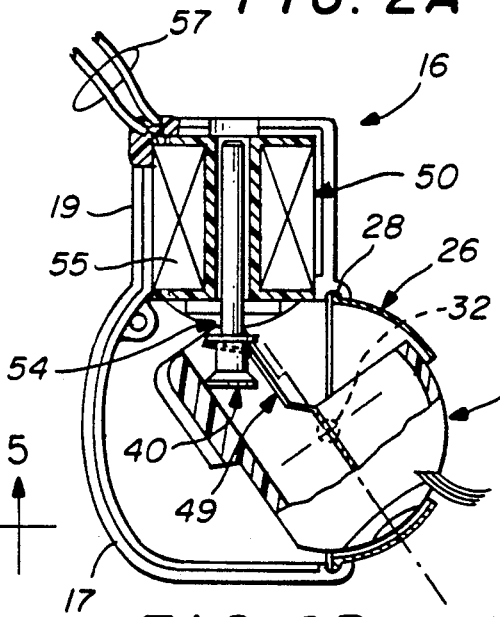
FIG. 2B is a cross section of the novel eye-moving mechanism of the present invention with the eyeball replica in the closed position.
Figure 7:
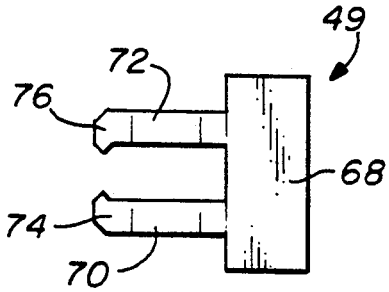
FIG. 7 is a top view of the spring mechanism attached to the eyeball replica for receiving an attachment portion of an elongated shaft that is coupled to a solenoid.
Figure 8:
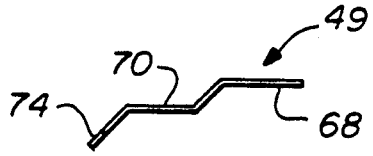
FIG. 8 is a side view of the novel spring fingers illustrated in FIG. 7.

FIG. 2 illustrates the details of the eye mechanism 16. Again, the lower portion 17 is in the form of a first hollow cylinder. It has an open end 31 for pivotally receiving the eyeball replica 18 such that the pupil 15 of the eyeball replica 18 faces out of the open end 31 of the first hollow cylinder 17. The second hollow cylinder 19 is above and has it longitudinal axis normal to the longitudinal axis of the first hollow cylinder 17 and receives a solenoid winding 50 on a supporting hollow core 51 and is I-shaped in cross section with the hollow opening 59 in the center 52 thereof and around which center 52 a coil 55 is wound. The core 51 has an upper horizontal portion 53 and lower horizontal portion 54. The conductors 57 that couple power to the solenoid coil 55 exit orifice 62 at the back of the housing 16. An elongated metal shaft 54, such as steel, and that can be attracted by a magnetic field, is inserted in the hollow center of core 52 in the coil 55 and has its lower end fixedly fastened in an orifice 47 in a spool 40 that is I-shaped in longitudinal cross section. A pair of spaced attached fingers 49, more clearly shown in FIGS. 7 and 8, are attached to the back portion 58 of the eyeball 18 for placement about the center portion 44 of the I-shaped spool 40. Back portion 58 of the eyeball replica 18 has a lower portion 38 and an upper portion 39. As can be seen best in FIG. 15, upper portion 39 has first and second spaced projections 90 upon which a flat portion 68 of the spaced fingers 49 rests and is attached to the eyeball replica 18. Other details disclosed hereafter in relation to FIGS. 2A and 2B will be seen in FIGS. 3, 15 and 16. Upon movement of the elongated shaft 54 longitudinally in either direction, the spaced fingers 49 catch one of the top 46 and bottom 48 horizontal portions of the I-shaped spool 42 to cause the eyeball replica 18 to move about its pivot points 32. Pivots points 32 on each side of the eyeball 18 extend into arcuate recesses 34 for pivotal movement therein. The bottom horizontal portion 48 of spool 40 has a sloped surface 51 extending inwardly and downwardly to the center portion 44 of the spool 40. An eye shield 26 is substantially hemispherical in shape and is attached to the open end 31 of the first hollow cylindrical portion 17 of the housing 16. A substantially oval-shaped opening 13 in the eye shield 26 allows the pupil 15 of the eyeball replica 18 to be seen as it pivots to give the appearance of the eye blinking. An annular recess 30 is formed in the first hollow cylindrical portion 17 of the housing adjacent the open end 31. An annular flange 28 on the base of the substantially hemispherical eye shield 26 is inserted in the annular recess 30 to secure the eye shield 26 to the housing 16.

When the solenoid 50 is de-energized, the weight of the elongated metal shaft 54 attached spool 40 is located behind the pivot point 32 such that the weight of the shaft 54 holds the eyeball pupil 15 in the forward or first position and when the solenoid is energized, the metal shaft 54 is attracted upwardly causing the spool 40 to move upwardly to its position shown in FIG. 2B thus moving the spaced fingers 49 from the position shown in FIG. 2A to the position shown in FIG. 2B. Since the fingers 49 are attached to the eyeball replica 18, the eyeball replica 18 pivots upwardly about its pivot point 32 and, if the shaft 54 is moved its total distance to the top, the eye would appear completely closed. It can, of course, move to positions in between fully opened and fully closed, the position being determined by the amount of current applied to the solenoid 50.

Figure 3:
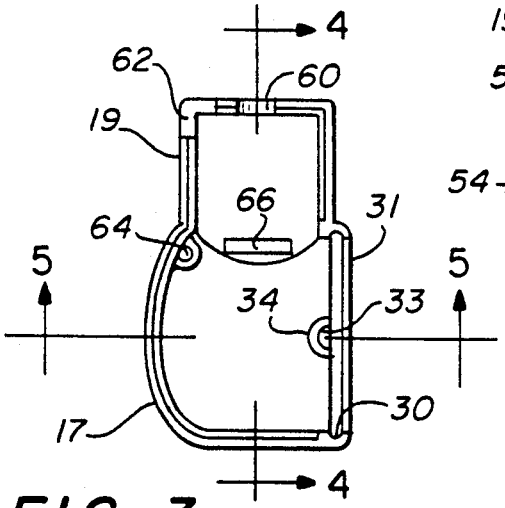
FIG. 3 is a side view of one-half of the housing illustrated in FIGS. 2A and 2B.

FIG. 3 is a cross-sectional side view of the housing for the eye mechanism 16. The first hollow cylindrical portion 17 at the bottom can be seen with the open end 31 for pivotally receiving the eyeball replica such that the pupil of the eyeball replica would face out the open end 31. An arcuate portion 34 has a recess 33 in which the projections 32 on the eyeball replica 18 mate for forming a pivot point. An orifice 64 is formed on the backside of the first hollow cylinder 17 to receive a corresponding projection on the opposite half of the housing for mating the two halves together to form an eye mechanism mounting 16. The upper solenoid housing portion 19 is the second hollow cylinder that is above and has its longitudinal axes normal to the longitudinal axis of the first hollow cylinder 17 and receives the hollow solenoid 50. The opening 60 is in alignment with the solenoid orifice 59 and allows movement of the shaft 54 that is inserted therein. The opening 62 in the back thereof is for the wires 57 for the solenoid 50 to project therefrom so they can be connected to an electronic drive circuit (not shown). A projection 66 extends inwardly from near the junction of the upper hollow cylinder 19 to the lower hollow cylinder 17. It supports the solenoid coil 55 and core 51 and holds the core 51 in a fixed position in the housing 16.

Figure 4:
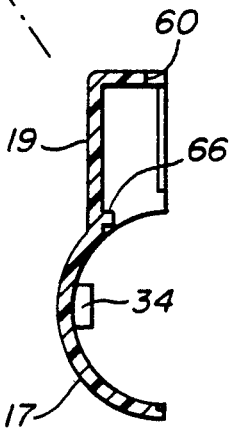
FIG. 4 is a cross-sectional view taken along lines 4—4 of FIG. 3.

FIG. 4 is a cross-sectional view of the one-half of housing 16 shown in FIG. 3 taken along lines 4—4. The back of the arcuate support 34 that forms a pivot point for the eyeball replica can be seen. In addition, the support 66 for the solenoid housing can also be seen and the opening 60 at the top thereof for the solenoid shaft 54 can also be seen.

Figure 5:
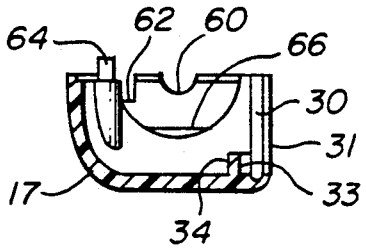
FIG. 5 is a cross-sectional view taken along lines 5—5 of FIG. 3.

FIG. 5 is a cross-sectional view of FIG. 3 taken along lines 5—5 looking upwardly. FIG. 5 illustrates the eyeball replica pivot point recess 33 formed by the arcuate portion 34. It also illustrates the open end 31 with the annular recess 30 in the first hollow cylindrical portion 17 of the housing 16 adjacent the open end 31. In the upper cylindrical portion 19, the projection 66 can be seen that holds the solenoid coil 55 and core 51 in place and the orifice 60 for the solenoid shaft 54. The opening 62 for the solenoid electrical wires can also be seen.

Figure 6:
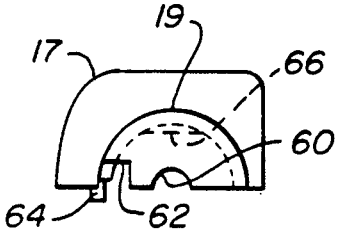
FIG. 6 is a top view of the one-half of the housing shown in FIG. 3.

FIG. 6 is a top view of the one-half of the housing 16 in FIG. 3 illustrating the first hollow cylinder 17 having the open end 31 and the second hollow cylinder 19 above and having its longitudinal axis normal to the longitudinal axis of the first hollow cylinder 17 for receiving the hollow solenoid 50. The orifice 60 for the solenoid shaft 54 and the orifice 62 for the solenoid connecting wires 57 can also be seen.

FIG. 7 is a plan view of the pair of spaced fingers 70 and 72 forming part of and extending from a base portion 68 which can be attached to the upper portion 39 of the eyeball replica 18. The spaced fingers are placed about the center portion 44 of the I-shaped spool 40 such that upon movement of the solenoid shaft 54 longitudinally in either direction, the spaced fingers catch the top 46 or the bottom 48 horizontal portions of the I-shaped spool 40 to cause the eyeball replica 18 to move about its pivot points 32. The fingers 49 have the outward ends 74 and 76 thereof turned downwardly and inwardly as can be seen in FIG. 8. When mounted to the eyeball replica 18, these ends 74 and 76 engage the I-shaped spool 49 as can be seen in FIG. 2. The sloped shoulder 42 on the I-shaped spool 40 and the upper and lower ends 46 and 48 thereof cooperate with the downwardly and inwardly turned fingers 74 and 76 as can be seen in FIG. 2 to pivot the eyeball replica 18 about its pivot points 32.

Figure 10:
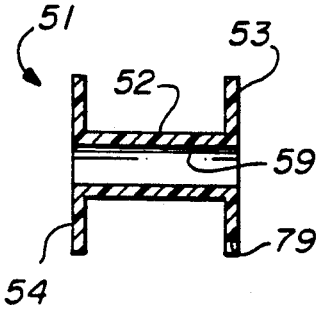
FIG. 10 is a cross-sectional view of the solenoid hollow core of FIG. 9.
Figure 11:
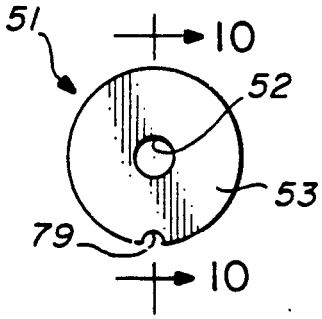
FIG. 11 is a top view of the solenoid hollow core of FIG. 9.
Figure 9:
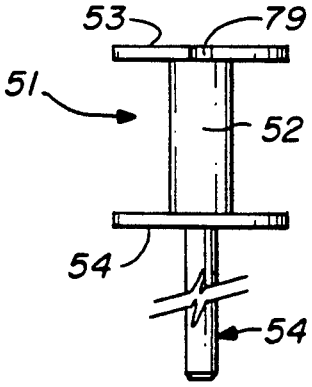
FIG. 9 is a side view of the hollow core for the solenoid winding.

FIGS. 9, 10 and 11 are front longitudinal cross-sectional and top views, respectively, of the hollow core 51 of solenoid 50. It is simply I-shaped in cross section having an upper horizontal portion 53 and a lower horizontal portion 54 coupled by a hollow center portion 52 that has therein an orifice 59 for receiving the elongated solenoid shaft 54. A small recess 79 in the top portion 53 thereof enables the wiring 57 to project therefrom for receiving the current for the solenoid coils 55 when wound thereon.

Figure 12:
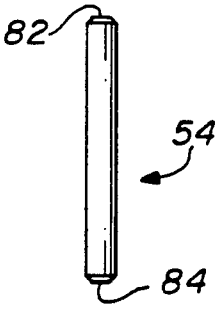
FIG. 12 is a side view of an elongated shaft to be attached at one end to the hollow center of the spool of FIGS. 16, 17 and 18 and the other end inserted in the solenoid hollow core shown in FIG. 9.

FIG. 12 is a plan view of the elongated steel shaft 54 that serves as the solenoid shaft. It can be seen that it has tapered ends 82 and 84. The orifice 47 of spool 40 shown in FIG. 2 receives one end of shaft 54 in any well-known manner such as by press fit.

Figure 13:
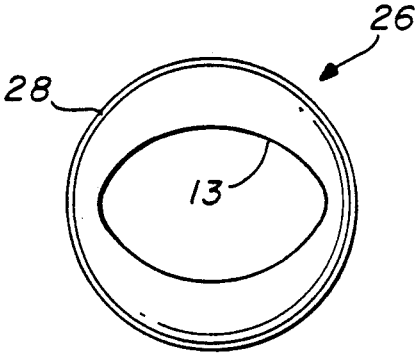
FIG. 13 is a front view of the eye shield illustrated in FIGS. 2A and 2B to provide protection around the periphery of the eye and form an eye shape.

FIG. 13 is a front view of the eye shield 26 shown in FIG. 2. It has the substantially oval-shaped opening 13 therein through which the pupil 15 of the eyeball replica 18 can be seen as it pivots to give the appearance of the eye blinking. The annular flange 28 on the base of the substantially hemispherical eye shield 18 for insertion in the annular recess 30 adjacent the open end 31 of the cylindrical housing portion 17 can be seen. This enables the eye shield 26 to be secured to the housing portion 17.

Figure 14:
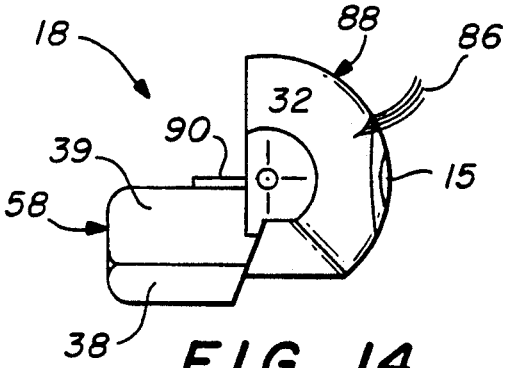
FIG. 14 is a side view of the novel eyeball replica.

FIG. 14 is a side view of the eyeball replica 18. It has a pupil 15 on the forward portion thereof and an eyelash section 86 above the pupil. It has a hemispherical eyeball portion 88 and a rear portion 58. The pivot projections 32 are on each side of the eyeball portion 88.

Figure 15:
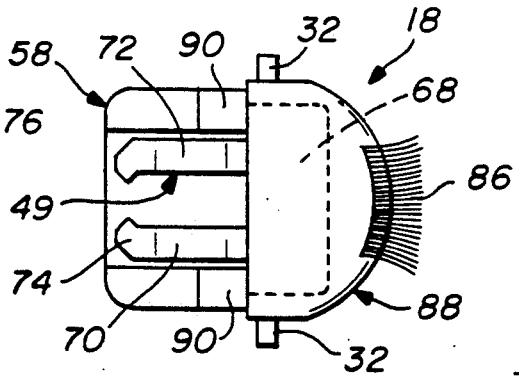
FIG. 15 is a top view of the novel eyeball replica of FIG. 14.

FIG. 15 is a top view of the eyeball replica 18. The eyelash section 86 can be seen on the forward portion 88 of the eyeball replica 18 and the pivot projections 32 can be seen on each side thereof. The pair of spaced fingers 70 and 72 extend from base portion 68 that is attached to the eyeball replica 18 on spaced, raised surfaces 90 in any well-known manner. The spaced fingers 70 and 72 receive the I-shaped spool 40 by extending on each side of the center 44 of the I-shaped spool 40 as shown in FIG. 2 to enable the eyeball replica 18 to be pivoted about its pivot points 32.

Figure 18:
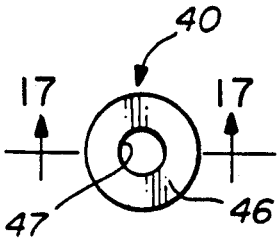
FIG. 18 is a top view of the attachment spool of FIG. 16.
Figure 17:
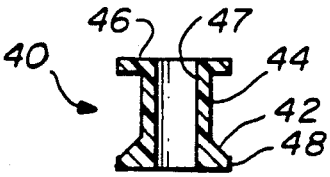
FIG. 17 is a cross-sectional view of the attachment spool of FIG. 16.
Figure 16:
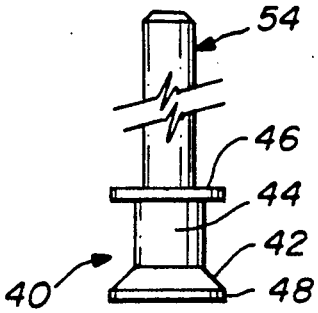
FIG. 16 is an elevation view of the attachment spool for pivotally attaching the solenoid operated elongated shaft to the eyeball replica.

FIGS. 16, 17 and 18 are elevation, cross-sectional and top views of the I-shaped spool 40. The sloping shoulder 42 is on bottom horizontal portion 48. Hollow center portion 44 connects the top horizontal portion 46 to bottom horizontal portion 48. An orifice 47 is formed in center portion 44 to receive the elongated solenoid driven shaft 54.

Thus, there has been disclosed a novel apparatus for animating a figurine movable element that is simple and economical to manufacture and yet operates easily in a realistic fashion. The specific embodiment disclosed is an eye mechanism for mounting in an animated figure to enable the eyeball replica with a pupil thereon to appear to blink. Simply by pivotally attaching the eyeball replica to a housing at opposed pivot points allows the eyeball replica to rotate between first and second positions. A small hollow solenoid winding on the housing has one end of a shaft inserted therein and the other end pivotally attached to the eyeball replica behind the pivot point such that the weight of the shaft holds the eyeball pupil in the first position when the solenoid is de-energized to cause the eye to have the appearance of being open. The eyeball replica moves to a second position when the solenoid is energized to cause the eye to appear to blink. A small space is left between the shoulders of an I-shaped spool for receiving spaced fingers attached to the eyeball replica. This small space allows the eyeball replica to be pivoted upwardly and downwardly upon movement of the solenoid shaft without any interference with the spaced fingers. It also allows realistic movement of the eyes as if they were blinking.

While the invention has been shown and described with respect to a particular embodiment thereof, this is for the purpose of illustration rather than limitation; other variations and modifications of the specific embodiment herein shown and described will be apparent to those skilled in the art all within the intended spirit and scope of the invention. Accordingly, the patent is not to be limited in scope and effect to the specific embodiment shown and described nor in any other way that is inconsistent with the extent to which the progress in the art has been advanced by the invention.

We claim:

1. An eye mechanism for mounting in an animated figure to enable an eyeball replica with a pupil thereon to appear to blink, the mechanism comprising:
- a housing coupled to the animated figure;
- a replica of an eyeball having an eye pupil thereon;
- pivot means for attaching the eyeball replica to the housing at a pivot point to allow the eyeball replica to rotate between a first position and a second position;
- a hollow solenoid on the housing;
- a shaft having one end inserted in the hollow solenoid and the other end pivotally attached to the eyeball replica behind the pivot point such that the weight of the shaft holds the eyeball pupil in the first position when the solenoid is de-energized and the eyeball pupil is pivoted to the second position when the solenoid is energized to cause the eye to appear to blink;
- a pair of spaced flanges fixedly attached to the other end of the shaft; and
- a pair of spaced fingers attached at one end to the eyeball replica between the spaced flanges such that upon movement of the shaft longitudinally in either direction, the spaced fingers catch one of the spaced flanges to cause the eyeball replica to move about its pivot points, 2. An eye mechanism as in claim 1 wherein the housing comprises:
- a first hollow cylinder having an open end for pivotally receiving the eyeball replica such that the pupil of the eyeball replica faces out of the open end; and
- a second hollow cylinder above and having its longitudinal axes normal to the first hollow cylinder for receiving the hollow solenoid winding.

3. An eye mechanism as in claim 2 further including:
- a recess on each side of the open end of the first hollow cylinder in opposed relationship; and
- a projection on each side of the eyeball replica for mating with the opposed recesses such that the eyeball replica is pivotable about the projections.

4. An eye mechanism as in claim 1 wherein the animated figure is a human form.

5. An eye mechanism as in claim 1 wherein:
- the spaced flanges in a central portion therebetween form a generally I-shaped spool;
- a conduit extends longitudinally through the I-shaped spool; and
- the solenoid shaft is press fit into the conduit for attachment thereto.

6. An eye mechanism as in claim 2 further comprising:
- a substantially hemispherical eye shield attached to the open end of the first hollow cylindrical portion of the housing; and
- a substantially oval-shaped opening in the eye shield through which the pupil of the eyeball replica can be seen as it pivots to give the appearance of blinking.

7. An eye mechanism as in claim 6 further including:
- an annular recess in the first hollow cylindrical portion of the housing adjacent the open end; and
- an annular flange on a base of the substantially hemispherical eye shield for insertion in the annular recess to secure the eye shield to the housing.

8. An eye mechanism as in claim 7 wherein the housing further comprises:

first and second complementary housing halves, each half containing:

a portion of the annular recess in the first hollow cylinder for receiving the annular flange of the eye shield;

a portion of the first hollow cylinder for receiving the eyeball replica; and a recess for receiving a projection on the eyeball replica to enable pivoting thereof; and a portion of the second hollow cylinder receiving the hollow solenoid; and holding means on the portion of the second hollow cylinder for engaging the hollow solenoid and holding it securely in the second hollow cylinder.

9. An eye mechanism as in claim 6 further comprising:

eyelashes attached to the eyeball replica above the pupil; and a flesh tone coloring covering at least a portion of the eyeball replica above the eyelashes such that when the eyeball replica pupil is pivoted downwardly, the flesh tone coloring is exposed in the oval-shaped opening of the eye shield to cause a realistic appearance of the eye blinking.

* * * * *